United States Patent [19]

VanderWert

[11] 4,118,252

[45] Oct. 3, 1978

[54] PROCESS FOR ALBEDO CONTROL OF MOLYBDENUM ARTICLES

[75] Inventor: Terry L. VanderWert, S. St. Paul, Minn.

[73] Assignee: Buckbee-Mears Company, St. Paul, Minn.

[21] Appl. No.: 794,736

[22] Filed: May 9, 1977

[51] Int. Cl.[2] ..... G02B 1/10

[52] U.S. Cl. ..... 148/6.3; 427/126; 427/162; 350/276 R

[58] Field of Search ..... 148/6.3; 427/111, 101, 427/103, 126, 160, 162

[56] References Cited

U.S. PATENT DOCUMENTS 3,577,275 5/1971 Kosco et al. ..... 427/125

OTHER PUBLICATIONS

Liebhafsky, Chem. Abs., vol. 41:1158i, 1947.

Vladimirova et al., Chem. Abs., vol. 56:4470i, 1962.

*Primary Examiner*—Ralph S. Kendall

[57] ABSTRACT

A process for obtaining the proper albedo of a molybdenum article by oxidation of the surface of the article through control of the oxidation temperature, the oxidation time, and the atmosphere so as to prevent destruction of the physical characteristics of the molybdenum article.

2 Claims, No Drawings

PROCESS FOR ALBEDO CONTROL OF MOLYBDENUM ARTICLES

BACKGROUND OF THE INVENTION

1. Field of the Invention

This application relates generally to albedo control and more specifically, to a process of reducing the albedo of a molybdenum article through a process of oxidation.

2. Description of the Prior Art

One of the proposed uses of molybdenum articles is in optical display units which have conventionally used stacked nixie tubes and the like. In order to use molybdenum articles in optical display units, it is necessary to reduce the albedo of the molybdenum article. One way of reducing the albedo of the surface of the molybdenum article is to oxidize the surface. However, the process of oxidation not only reduces the albedo of a molybdenum article but oftentimes changes the physical characteristics of the molybdenum in the article.

A typical prior art oxidation process is generally described in the Kosco U.S. Pat. No. 3,577,275. Kosco states that to oxidize tungsten or molybdenum one can use temperatures as low as 800° F. if very long time periods are permissible and temperatures as high as 1800° F. if short times are permissible. Kosco states the preference being oxidizing in the air for 1 to 2 hours at about 1500° F. An analysis of oxidized articles made under these times and temperatures reveals that physical change occurred to the articles which rendered the article unsuitable for its ultimate use. For example, it was found that Kosco's suggested temperature and times causes the molybdenum article to become brittle. Also at high temperature a white coating was produced on the surface of the molybdenum article. Obviously, the white surface does not have the proper albedo.

The Marden et al U.S. Pat. No. 1,861,637 discloses a process of oxidation in connection with the production of alkali metal tubes. After a cleaning process, an oxide layer is formed on either a tungsten or molybdenum filament by exposing the filaments to an oxygen atmosphere having atmospheric pressure at a temperature of approximately 2000° C. for ½ minute. Marden suggests that instead of oxygen, ordinary atmospheric air may be used but this requires a pressure of from 3 to 4 times that of the oxygen.

The VanGessel U.S. Pat. No. 1,699,639 shows a method for forming an oxide layer on a tungsten wire by heating in air at a temperature of about 700° C. and then exposing to a reducing vapor.

The Foulke U.S. Pat. No. 1,628,456 discloses a method of forming an oxide layer on tungsten or other wire by exposing to a temperature of 850° C. to 950° C. for approximately 0.002 minutes.

The present process is the discovery of a range of relationships which produce an oxidized surface which has the necessary albedo reduction without affecting the physical characteristics of the article.

SUMMARY OF THE INVENTION

Briefly, the present invention comprises a process for oxidizing the surface of a molybdenum article in an air atmospheric by controlling the time and temperature of the oxidation environment.

DESCRIPTION OF THE PREFERRED EMBODIMENTS

In the preferred embodiment a molybdenum article is etched or formed to the desired configuration through processes well known in the art. After the molybdenum article has been formed to the desired configuration, the molybdenum article is thoroughly cleaned with suitable solvents. After thorough cleaning the article is placed on a support such as a ceramic block or the like. The ceramic block and molybdenum article are then placed into an air oven. The temperature range within the oven is maintained between 850° F. and 950° F. The molybdenum article is left in the oven a minimum of 25 minutes and usually no longer than 35 minutes. If the temperature is decreased below 850° F. it requires a longer time to produce an oxide coating. However, tests have shown the quality of the oxide coating is inferior at lower temperatures.

If the temperature of the process increases to 1100° F. the quality of the coating becomes poor and the molybdenum article becomes brittle. In this case both the coating and the article become unsuitable for use. The following examples illustrate the process of the invention.

EXAMPLE 1

A flat etched molybdenum article having a thickness of about 0.010 inches and a width of 0.75 wide and length of 6 inches was cleaned to remove organic and inorganic surface impurities. The article was placed in an air oven for 25 minutes at 900° F. When the article was removed there was a uniform dark gray oxide coating over the entire article.

EXAMPLE 2

The process was repeated with the same size molybdenum article, however, the temperature was raised to 1100° F. and the time was decreased to about 10 minutes. Upon removal from the oven the article had a white coating and the article was brittle.

EXAMPLE 3

The process of Example 1 was repeated except that the temperature used was about 400° F. and the time was about 2 hours. When the article was removed the oxide coating was not uniform over the article.

From the above examples and additional tests it was determined that to blacken or darken the surface of a molybdenum article it is preferred to maintain the temperature of the air from about 850° F. to about 950° F. and the time from about 25 minutes to about 35 minutes. It should be pointed out that through a trial and error procedure the temperature and time limits can be varied to produce an oxide coating of acceptable quality. However, when the temperature is in excess of 1100° F. the article's physical characteristics are changed. If the temperature is on the order of 400° F. or less the coating is usually not uniform.

In general it has been found that a temperature range in which the minimum temperature is in excess of 400° F. and the maximum temperature is less than 1100° F. is suitable for oxidizing the surface of the article without changing the physical characteristics of the article. However, times of heating become more critical at these extremes and the article must be closely monitored to insure that the proper oxidation occurs.

I claim:

1. The process of obtaining the proper albedo on the surface of a molybdenum article comprising:

A. cleaning the molybdenum article to remove impurities on the surface of the article;

B. heating the molybdenum article in an air atmosphere to a temperature in excess of 400° F. but less than 1100° F. for about 25 minutes to about 35 minutes until the surface of the article has been oxidized; and C. allowing the molybdenum article to cool.

2. The process of claim 1 wherein the minimum temperature of heating said molybdenum article is about 850° F. and the maximum temperature is about 950° F.

* * * * *